United States Patent [19]

Ohayon

[11] Patent Number: 4,646,981

[45] Date of Patent: Mar. 3, 1987

[54] PROCESS AND APPARATUS FOR THE SIMULTANEOUS THROWING OF SEVERAL TEXTILE THREADS DELIVERED CONTINUOUSLY

[75] Inventor: Gabriel Ohayon, Francheville le Haut, France

[73] Assignee: Rhone-Poulenc Fibres, Lyon, France

[21] Appl. No.: 799,740

[22] Filed: Nov. 19, 1985

[30] Foreign Application Priority Data

Nov. 20, 1984 [FR] France ..... 84 17773

[51] Int. Cl.[4] ..... B65H 54/02; B65H 54/20

[52] U.S. Cl. ..... 242/18 PW; 242/35.5 R

[58] Field of Search ..... 242/18 PW, 18 R, 35.5 R, 242/35.5 A

[56] References Cited

U.S. PATENT DOCUMENTS

| | | | |
|---|---|---|---|
| 4,136,834 | 1/1979 | Tschentscher | 242/18 PW |
| 4,230,283 | 10/1980 | Hamaguchi et al. | 242/18 PW |
| 4,313,576 | 2/1982 | Claret et al. | 242/18 PW |
| 4,340,187 | 7/1982 | Schippers et al. | 242/35.5 A |
| 4,342,430 | 8/1982 | Kasai et al. | 242/18 PW |
| 4,456,187 | 6/1984 | Bloomfield et al. | 242/18 PW |
| 4,465,242 | 8/1984 | Ari et al. | 242/18 PW |
| 4,477,032 | 10/1984 | Pfyffer et al. | 242/18 PW |

FOREIGN PATENT DOCUMENTS

| | | | |
|---|---|---|---|
| 2378708 | 9/1978 | France | 242/18 PW |
| 2002431 | 2/1979 | United Kingdom | 242/18 PW |

*Primary Examiner*—Stanley N. Gilreath

*Attorney, Agent, or Firm*—Sherman and Shalloway

[57] ABSTRACT

The invention relates to a process and an apparatus for the simultaneous throwing of several textile threads delivered continuously, for the purpose of winding them in separate packages on one and the same spindle of a reeling machine.

in a first stage, the threads are arranged according to separate paths defined by separate triangulation guides located upstream of the spindle and by a common point of convergence located downstream, in a second stage, being kept out of reach of the traversing system, they are grasped selectively by a selection device consisting essentially of a movable elongate element, of the belt type, which is provided with selection guides of different increasing lengths spaced out at regular intervals along the belt and each brought opposite its package zone on the spindle, in a third stage, they are moved up to a means of picking them upon their supports in order to start the packages.

The invention is used for the throwing of threads, particularly in a completely automatic change-over process.

10 Claims, 14 Drawing Figures

PROCESS AND APPARATUS FOR THE SIMULTANEOUS THROWING OF SEVERAL TEXTILE THREADS DELIVERED CONTINUOUSLY

The present invention invention relates to a process and an apparatus for the simultaneous throwing of several textile threads delivered continuously, for the purpose of winding them on the same spindle. It relates more particularly to a process and an apparatus for selecting and positioning threads, used during the throwing operation.

At the present time, for the simultaneous winding of several threads delivered continuously, the textile industry makes use of a type of reeling machine comprising a spindle, which is rotated, and on which several package support tubes can be mounted, a traversing thread distribution device and a triangulation guide for each package. The spindle can be rotated about its axis or can be driven tangentially by peripheral contact between the packages and a pilot cylinder or by combination of these two means. Thus, a pilot cylinder is often provided whose function is to control the tangential speed of the packages, whilst at the same time supplying all or some of the torque necessary for driving them. The traversing thread distribution device incorporates as many thread guides as there are threads to be wound, and usually they have an automatic thread take up facility. For each package there is a fixed triangulation guide arranged upstream of the traversing guide and located on the mid-perpendicular of the segment representing the travel of the traversing guide.

This type of reeling machine is capable of winding threads delivered at high speed, that is to say at speeds which can reach 6,000 to 7,000 m/min and more. To allow it to be used, it is necessary to throw all the threads simultaneously when starting the packages, and this starting occurs whenever production begins and then during each change-over operation. "Change-over" refers to the following operations as a whole: replacement of the full thread supports by empty supports and the transfer of the feed threads from the full supports to the empty supports. Change-over can be carried out manually, but increasingly it is carried out semi-automatically and preferably completely automatically.

The simultaneous throwing of several threads on one and the same spindle during a change-over operation requires a stage involving selecting each thread and positioning it in its proper place before it is picked up. This is an important and difficult stage, above all when an automatic change-over process, in which each stage must take place with maximum reliability, is adopted.

There are processes and apparatuses for the simultaneous throwing of several threads on one and the same spindle, which can be carried out during semi-automatic or automatic change-over operations.

The European Patent Application published under No. 051,222 relates to such a process and an apparatus for carrying it out in a semi-automatic change-over mode. According to the process, in a first step, the threads, (for example, 4 of them) are positioned on converging paths passing through the triangulation guides, a first bearing ramp putting them out of reach of the traversing guides and a manually actuated suction gun arranged downstream of the spindle; in a second step, according to one option, downstream guides pivoting in a plane perpendicular to the axis of the spindle each grasp one thread; in a third step, the downstream guides execute a translational movement in a direction parallel to the axis of the spindle and bring each thread opposite a pick-up slot in its package support, a second notched bearing ramp located between the traversing system and the first ramp participate in the positioning of the threads; in a fourth step, the downstream guides execute a second pivoting which causes the threads to be brought in contact with their pick-up slot and, since the spindle is rotating, causes the starting of the packages.

In the European Application published under No. 051,223, a general principle and an apparatus close to those of the preceding document are used, but there are differences in the form of construction of the downstream guides. These are only capable of a pivoting movement opposite their pick-up slot. There is, in this case, a second series of guides which are mounted on a rail parallel to the spindle which comes into effect during the second and third steps, and whose function it is to grasp each thread and bring it up to its respective downstream guide.

According to Swiss Pat. No. 631,677, after the threads have been grasped on the triangulation devices by means of a movable nozzle, the said nozzle is moved into a downstream position relative to the spindle, thus causing the threads to be positioned in converging paths defined by the triangulation guides, a guide ramp being integral with the reeling machine and being arranged downstream of the spindle and the said nozzle. In a second stage, preferably by mechanical means, the nozzle is made to execute a translational movement in a direction parallel to the axis of the spindle, thus causing the threads to slide along the guide ramp and be grasped selectively via slots appropriately provided along this ramp; in a third stage, the pivoting of the guide ramp in the direction of the rotating spindle causes the threads to be picked up on their supports.

U.S. Pat. No. 4,340,187 relates to an automatic change-over mechanism serving a reeling machine provided with a pivoting laying-down arm (with pick-up guides) and piecing guides. The threads are taken up on the triangulation devices by means of sliding guides which bring the threads up to a suction nozzle, the assembly consisting of the guides and the nozzle being in an upstream position relative to the spindle. For throwing, the assembly, consisting of the guides and the nozzle, moves into the downstream position, and after the reels have been changed, the sliding guides move in the opposite direction to their first movement, bringing the threads in contact with the pick-up guides which selectively grasp the threads, because, for example these guides are provided with appropriately arranged and inclined insertion slots.

U.S. Pat. No. 4,136,834 relates to a process and an apparatus for the semi-automatic throwing of several threads on a reeling machine provided with an open longitudinal slot extending parallel to the spindle upstream of the traversing system. The process involves:

a first stage in which threads, manipulated by means of a gun and introduced into guides provided for the purpose, including movable downstream guides, are guided together, but spaced apart at one end and at the front of the reeling machine, a second stage in which, as a result of the translation of the downstream guides, the threads are moved through the slot, out of range of the retracted traversing system, in a direction parallel to the spindle and are each positioned opposite a package support near a pick-up slot, third stage in which, by being brought in contact with the supports and shifted slightly parallel to the spindle, the threads are inserted simultaneously into the pick-up slots.

The apparatuses described above function effectively in theory, but not all of them can be operated automatically, and they have a certain complexity which does not lead to a high degree of reliability, above all where a completely automatic process is concerned.

The present invention proposes a simple process and apparatus which offer good reliability and which are designed for high speeds and the automatic mode.

According to the present invention there is provided a process for the simultaneous throwing of several textile threads delivered continuously, for the purpose of winding them in separate packages on several spools mounted in spaced relation on one and the same spindle of a reeling machine, the spindle being rotated about its axis, the reeling machine also being provided with at least one traversing thread distribution device having several traversing guides and being preceded by triangulation guides, said method comprising the steps of:

(a) in a first stage:

(i) taking up all the threads downstream of the triangulation guides in a take up device;

(ii) moving the take up device to a point such that the threads pass in front of the spindle and so that the threads extend to a point of convergence defined by the position of the take up device, the point of convergence being downstream of the spindle, and whereby the threads lie in a common plane at least immediately upstream of the point of convergence;

(b) in a second stage:

(i) providing a set of movable, equally spaced guides, equal in number to the number of threads to be wound, the guides being of progressively increasing length and the spacing between the guides being equal to the spacing between the spools on the spindle;

(ii) moving the guides transverse to their length along a first path portion which is at an angle to said common plane, said first path portion including a grasping zone adjacent said common plane, whereby said movable guides each engage in turn in a separate one of said threads;

(iii) moving the guides transverse to their length along a second path portion substantially parallel to the axis of the spindle until the movable guides, with the threads thereon, are each adjacent their respective spool;

(iv) causing the yarns, during the movement along the second path portion to bear against a guide ramp parallel to the spindle, the guide ramp being in an active position which maintains them out of reach of the traversing guides;

(c) in a third stage, picking the threads up simultaneously on the spools on the rotating spindle.

The position of the point of convergence of the threads, take up means (usually a nozzle), is moved is determined as a function of the geometry of the reeling machine, the available space, the characteristics of the process and the possibility of accommodating the possible mechanical elements necessary for carrying out the process, such as a straight guide or a bearing plate serving to determine the plane of movement of the threads upstream of the point of convergence.

The height of the grasping zone in relation to the point of convergence, is determined on the basis of parameters, such as the spacing between the threads, the possible dimensions of the movable guides and the possibility of working with a variable number of threads (for example, four threads or two threads wound with a double stroke length).

The above defined angle of incidence preferably has a value in the neighbourhood of 45°. Since the second portion is substantially parallel to the spindle, a substantial change of direction occurs at the grasping zone.

Since the guides have increasing lengths in relation to the order in which they appear at the grasping zone, the first thread grasped is nearest the grasping zone and the last is furthest away.

Each guide preferably has a part, along which the thread can slide and which ends at the base of the guide. Each thread taken up by a guide slides along the latter to its base, where it is retained when the guides are in the advanced position.

To ensure that the threads are picked up in the third stage, all the movable guides are moved simultaneously in the direction of the spindle, thus bringing the threads in contact with their package support, and subsequently, for example by means of simultaneously sliding or pivoting fingers mounted on the reeling machine, the threads are moved in a direction parallel to the axis of the spindle, to bring each of them up to a pick-up means on the support; the said means preferably being a peripheral slot located near one end of the support.

The invention also relates to apparatus apparatus for the simultaneous winding of several textile threads delivered continuously, said apparatus comprising a spindle rotatable about an axis and upon which several spools can be mounted in spaced relation, several triangulation guides and at least one traversing thread distribution device, several traversing guides mounted on said at least one distribution device, take up means for taking up all of the threads downstream of said triangulation guides, said take up means being positionable at a point such that the threads pass in front of the spindle at a point of convergence defined by the take up means, with the threads then lying in a common plane at least immediately upstream of the point of convergence, a set of equally spaced movable guides, equal in number to the number of threads to be wound, the movable guides being of progressively increasing length, and the spacing between the movable guides being the same as the spacing between the spools carried by said spindle, means for moving the movable guides transverse to their length along a first path portion which is at an angle to said common plane, said first path portion including a grasping zone adjacent said common plane, whereby said movable guides can each engage in turn a separate one of said threads, means for subsequently moving said movable guides transverse to their length along a second path portion substantially parallel to the axis of the spindle whereby the yarns engaged thereby can each be positioned in front of a separate one of said spools and means for picking up the threads simultaneously from said movable guides and engaging them simultaneously on a separate one of said spools.

The elongate flexible element is preferably an endless belt stretched over pulleys, at least one of which is a drive pulley. When the selection device is in the "working" position relative to the reeling machine, the belt has at least one downstream strand parallel to the axis of the spindle and an upstream strand forming a specific angle with the downstream strand. The downstream strand defines the so-called "advanced" position of the guides, whilst the end zone of the upstream strand corresponds to the grasping zone.

The selection guides may have at their base a thread retention means which can consist of a shoulder formed between the said cylindrical or frusto-conical base and the active part. The latter is preferably of general frusto-conical shape, the small diameter being adjacent to the base defined above. The thread retention means of all the guides are all located at an equal distance from the elongate flexible element. Thus, in the advanced position, since the guides are arranged on the downstream strand parallel to the axis of the spindle, the retention means are likewise all arranged on one and the same line parallel to the axis of the spindle. The active parts, the function of each of which is to grasp a thread and then guide it by sliding up to the retention means, are all of different lengths, each being a function of the distance between the flexible element and the thread to be grasped at the grasping zone. Their diameter is selected according to the interval between two consecutive threads at the grasping zone.

Although it is possible to equip each reeling machine with a selection device such as that described above, this solution is not very advantageous. Preferably, the selection device forms an element of an automatic change-over mechanism serving a series of reeling machines. Advantageously, this is an automatic mechanism based on the same general principle as that claimed in the French Patent published under No. 2,267,272 filed on Apr. 11, 1974 in the name of the Applicant, but having differences from the latter, these arising essentially because the automatic mechanism used in the present application serves reeling machines for winding several threads on the same spindle, whereas the automatic mechanism according to the abovementioned reference serves reeling machines on which only a single thread is wound per spindle.

It is therefore an automatic mechanism for the automatic change-over of reeling machines, each compising at least one spindle for the simultaneous winding of several threads in separate packages, a traversing distribution guide and a triangulation guide for each thread. The said automatic mechanism is movable between a standby position and the reeling machines and possesses, in combination, at least the following elements mounted on a framework:

a nozzle for catching and discharging the moving threads under tension, provided with a straight catching slit and means of cutting the thread, movable nozzle mounting means which move the nozzle, on the one hand, from a retracted position towards catching positions located on the triangulations, in which positions the catching slit is arranged in the deflection plane common to all the threads, and, on the other hand, towards at least one throwing position located downstream of the spindle, a loading/unloading unit comprising at least two parallel spindles, one of which is a spindle receiving finished packages and another of which is a spindle for installing empty supports on the spindle of the reeling machine, a device for selecting and positioning the threads, such as that described above, which is movable from a "rest" position to at least one "working" position.

In addition to the selection and positioning device, the means of carrying out the process advantageously include an essentially straight fixed guide which is integral with the reeling machine and which is located upstream of the point of convergence, and the function of which is to determine the plane of movement of the threads upstream of the said point of convergence. This guide preferably consists of a notched bearing plate, the threads brushing against its edge at each notch in the first stage of the process.

In a known way, as indicated above, the means of carrying out the process also include a guide ramp integral with the reeling machine and extending along the zone covered by the traversing guides immediately upstream of the latter. The ramp according to the present application comprises a straight part parallel to the axis of the spindle and a curved part located at its end towards the front of the reeling machine. The relative positioning of the notched bearing plate and of the guide ramp and the shape of the curved end of the said ramp are determined so as to allow the threads which have escaped from the notches to slide from the notched plate up to the straight part of the ramp in the second stage of the process.

The means of carrying out the process include, furthermore, guides which are mounted on the reeling machine and are movable in a direction parallel to the axis of the spindle and the function of which is to shift each thread laterally up to its pick-up slot, in the third stage of the process. Advantageously, pivoting and/or sliding retractable fingers arranged upstream of the guide ramp are used.

However, the invention will be understood better with the aid of the examples and Figures given below as an illustration, but in a non-limiting way.

It should be noted that, for the sake of clarity in the Figures which are diagrammatic representations, the proportions between the distances and dimensions of the various components have not been strictly adhered to and may vary from one Figure to another. Moreover, only the elements necessary for a clear understanding of a particular Figure have been shown in it, and this may result in representations which are different from one Figure to another. All the Figures, nevertheless, relate to the same reeling machine.

Figure 1:
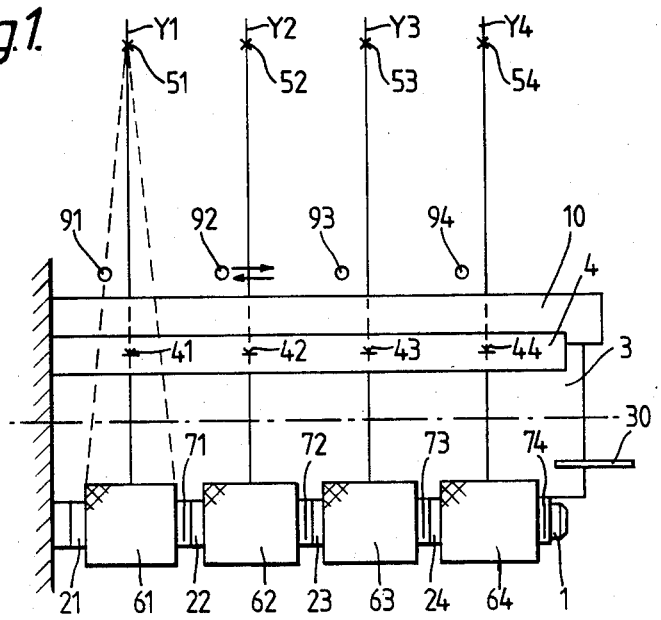
FIGS. 1 and 2 show, in a front view and an end view respectively, a reeling machine on which the invention can be put into practice.
Figure 2:
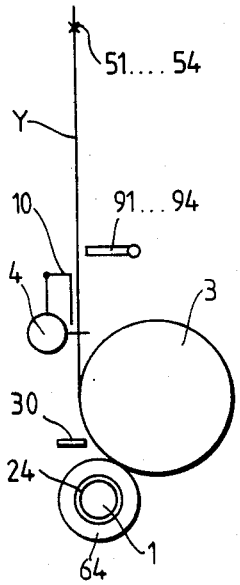

FIGS. 1 and 2 show diagrammatically, in a front view and an end view respectively, a type of reeling machine currently used in the textile industry for the simultaneous winding of several threads, four in this particular case. The reeling machine comprises a spindle 1, on which four package support tubes 21, 22, 23, 24 can be mounted, a pilot cylinder 3, a traversing thread-distribution device 4 and a triangulation guide for each package. The function of the pilot cylinder 3, in tangential contact with the tubes 21, 22, 23, 24 at starting and then with the packages 61, 62, 63, 64, is to control the peripheral speed of the packages, whilst at the same time supplying all or some of the torque necessary to drive them. The traversing thread-distribution device comprises four thread guides with automatic thread takeup 41, 42, 43, 44 intended respectively for the threads Y1, Y2, Y3, Y4 forming the packages 61, 62, 63, 64. For each package, there is a fixed triangulation guide 51, 52, 53, 54 arranged upstream of the traversing guide and located on the mid-perpendicular of the segment representing the travel of the traversing guide. The tubes 21 to 24 are provided near their end with peripheral pick-up slots 71 to 74 in the form of a circular arc.

To use this reeling machine, it is necessary to throw the four threads simultaneously onto the spindle to start the four packages. Conventionally, each package comprises a main package and a piecing end (not shown) arranged on the tube outside the zone of the main package and made at the start of winding.

To carry out the process for the simultaneous throwing of the threads, according to the invention, the reeling machine is also equipped with a guide ramp 10, a notched plate 30 for the accurate positioning of the threads in the fiFst stage and four fingers 91 to 94 for introducing the threads into the pick-up slots 71 to 74. These elements can be seen fully or partially in FIGS. 1, 2, 4, 5, 6, 11 and 12.

Figure 5:
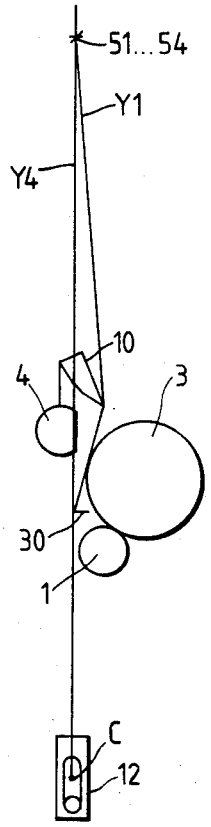
Figure 11:
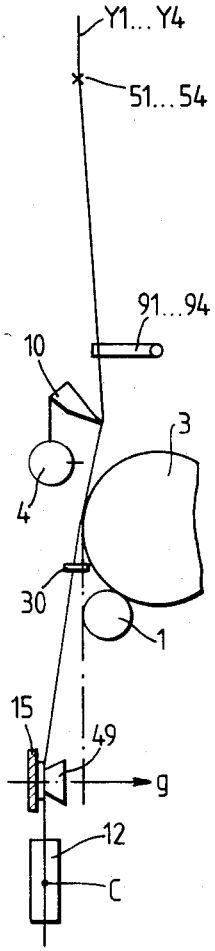
FIGS. 11 and 12 illustrate, in an end view and a front view respectively, the end of the second stage and the third stage of the process.

The guide ramp 10 extending along the zone covered by the traversing guides 41 to 44 is located upstream of the latter. It is mounted on the housing carrying the traversing device 4. It can assume an "active" position, as illustrated in FIGS. 5 and 11, or, by pivoting downwards, a retracted position in which it becomes inoperative (FIG. 2).

Figure 6:
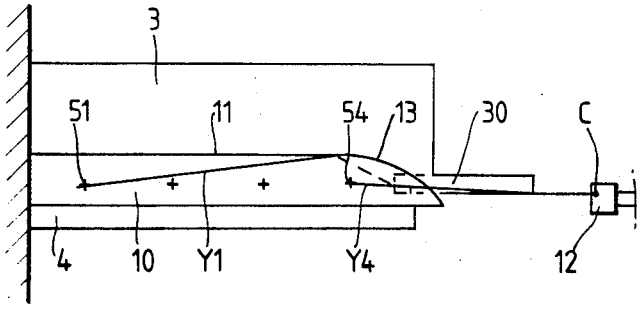

It comprises a straight part 11 parallel to the axis of the spindle and curved part 13 located at its end towards the front of the reeling machine (FIG. 6). The shape of this curved part 13 and its relative positioning in relation to the notched plate 30 allow the threads which have escaped from the notches to slide from the said notched plate to the straight part 11 of the ramp 10 in the second stage of the process.

The function of the notched plate 30 is to position the threads in one and the same plane upstream of the point of convergence C in the first stage of the process. It is fastened horizontally to the support (not shown) of the pilot cylinder 3, the threads brushing against its edge. In the example, it has 4 notches located at the points where the 4 threads pass onto the plate. The notches have a V shape which allows the threads to be held when they attracted by a suction means and to escape when they are subjected to a transverse pull parallel to the axis of the spindle, as in the second stage of the process.

The fingers 91 to 94 arranged upstream of the traversing device serve not only to introduce the threads into the pick-up slots, but also to make the piecing ends when these are provided. They can shift simultaneously in a horizontal plane in a to-and-fro movement, in a direction parallel to the axis of the spindle, from a retracted position to a position in which the thread is picked up by the slots. According to an embodiment which is not shown, they are integral with a link connected to a jack/crankhandle system which ensures the shifting movement.

Figure 7:
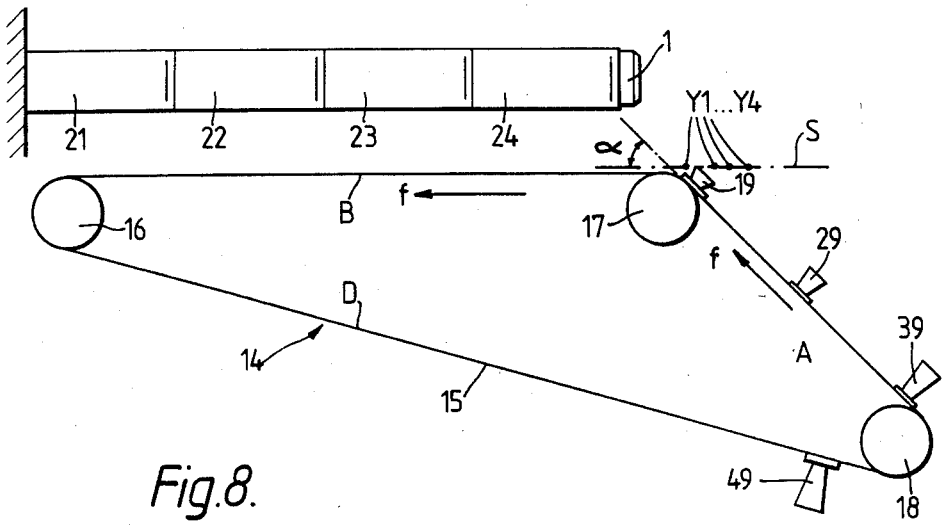
FIGS. 7 and 8 illustrate in a plan view the second stage of the process according to the invention and at the same time show the selector.
Figure 8:
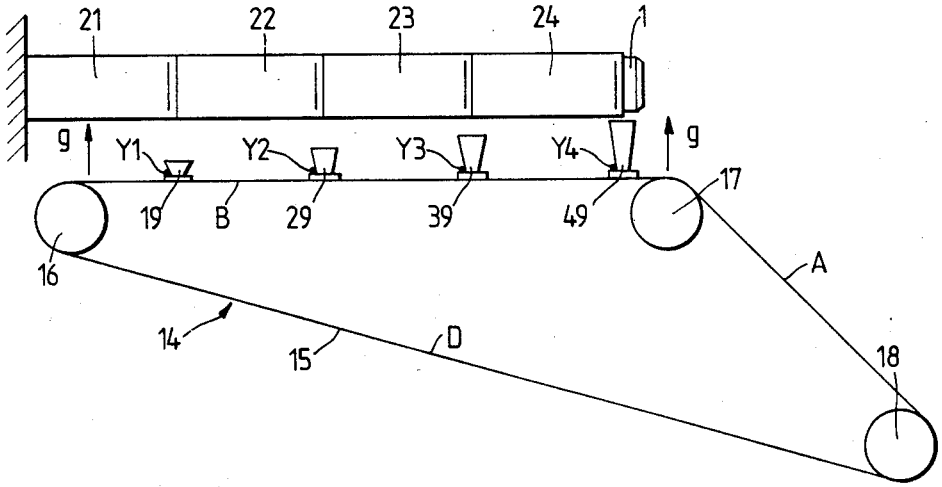

An exemplary embodiment of the thread selection and positioning device according to the invention is shown diagrammatically in the "working" position in a plan view in FIGS. 7 and 8 (general views) and 9 and 10 (partial views). FIGS. 7 and 8 also show the spindle 1 of the reeling machine.

This selection device or selector 14 is integral with an automatic change-over mechanism, such as that described in the general description, of which only the thread catching and discharge nozzle 12 is shown in the Figures. It incorporates an endless belt 15 stretched over three pulleys 16, 17, 18, one of which is a drive pulley driven by a reduction unit (not shown). The strand A located between the pulleys 17 and 18 forms an angle substantially of 135° with the strand B located between the pulleys 16 and 17, and during the change-over operation the latter is parallel to the axis of the spindle 1. The belt 15 carries four selection guides 19, 29, 39, 49 for the threads Y1, Y2, Y3, Y4 respectively. The spacing between the selection guides is equal to the spacing between the threads on the reeling machine (the distance between the traversing guides). Each selection guide comprises a cylindrical or frustoconical base surmounted by a frustoconical active part (the small diameter at the bottom); the four guides have different increasing lengths determined by the principle of selecting the threads according to the process claimed and described in detail below.

Figure 13:
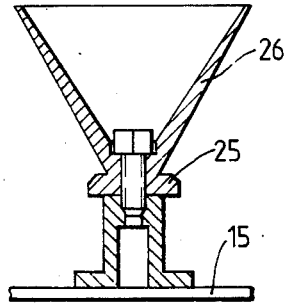
FIGS. 13 and 14 show two embodiments of the selection guides.
Figure 14:
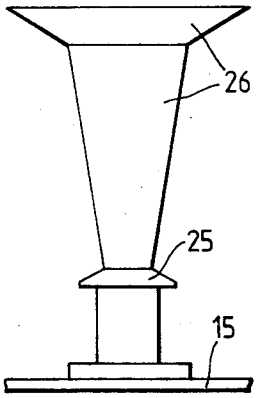

FIGS. 13 and 14 show two embodiments of the selection guide. In FIG. 13, the guide, seen in section, has a substantially cylindrical base 25 and a frustoconical active part 26. In FIG. 14, the guide has a base 25 of general frustoconical shape and an active part 26 in the form of a double truncated cone. The guides are made integral with the endless belt 15.

An automatic change-over operation, into which the throwing process according to the invention is integrated, is described below by way of example.

Figure 3:
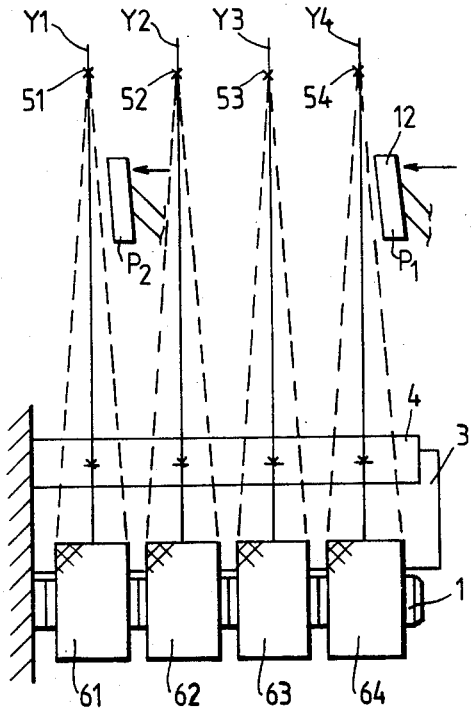
FIG. 3 illustrates a preliminary step in carrying out the process according to the invention, the reeling machine being viewed from the front.
Figure 4:
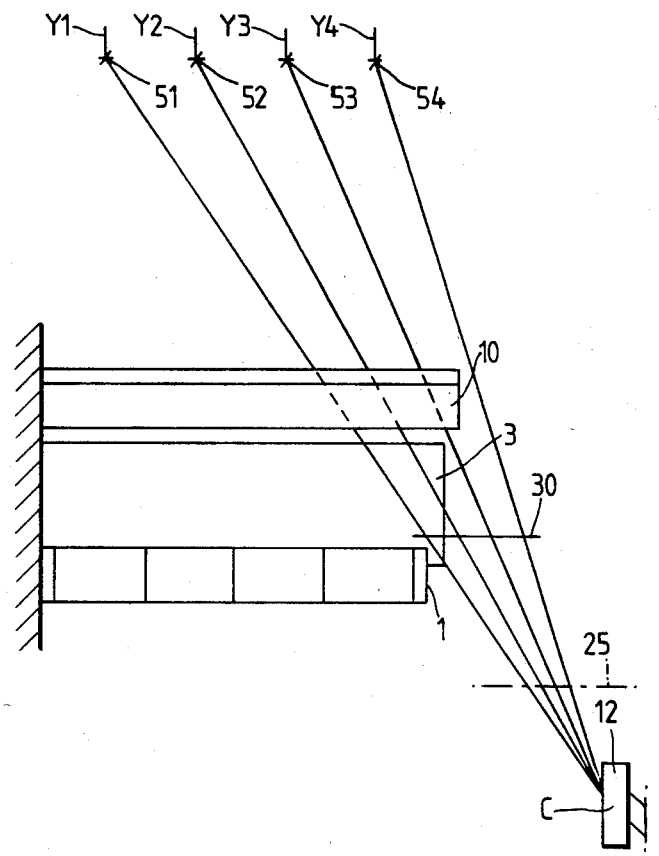
FIGS. 4, 5 and 6 illustrate the first stage of the process according to the invention, the reeling machine being shown in a front view, an end view and a plan view respectively.

When a reeling machine is to be changed over, it calls up the automatic mechanism which takes up position and locks on opposite the reeling machine. An automated sequence designed for the automatic mechanism and the reeling machine initiates the following operations:

1. Take-up of the threads on the triangulations together with consignment to waste FIG. 3 - by means of the nozzle 12 moving from the retracted position to the catching positions on the triangulation. In position P1, the nozzle prepares to grasp the thread Y4, and in position P2, the thread Y1. After the threads have been grasped, the nozzle 12 is retracted up to a position vertically above the predetermined point of convergence C (FIG. 4).

2. Stopping the spindle, releasing the tubes 21 to 24.

3. Extraction of the full tubes by means of the loading/unloading unit.

4. Installation of the empty tubes on the spindle 1 by means of the loading/unloading unit.

5. Locking of the tubes on the spindle 1.

6. Starting the reeling machine, bringing the tubes in contact with the pilot cylinder 3, and bringing the spindle 1 up to speed and stabilizing its speed.

7. Throwing the threads (FIGS. 4 to 12) by means of the process according to the invention involving the three stages:

*First stage: positioning the threads in a direct path from the triangulation guides to the point of convergence C.

*Second stage: selecting and positioning each thread opposite its package zone.

*Third stage: pick-up.

8. If appropriate, the formation of a piecing end.

The throwing operation 7 by means of the process according to the invention takes place as follows:

First stage (FIGS. 4, 5, 6): During the abovementioned change-over operations 5 and 6, the ramp 10 has pivotted into the "active" position and the nozzle 12 has taken up position at the point of convergence C. The four threads Y1 to Y4 follow the paths shown in the Figures, all bearing on the notched plate 30 and thus being arranged in the same plane between the said plate 30 and the point of convergence C. Upstream of the plate 30, it can be seen that the outer thread Y4 passes directly from its triangulation guide 54 to the plate 30, whereas the threads Y1 to Y3 in their corresponding paths come in contact with the ramp 10 at various locations. Since the ramp 10 is in the active position, the threads are out of contact with the traversing guides. The line 25 (FIG. 4) symbolizes the level of the zone where the threads are grasped by the selector 14 during the 2nd stage.

2nd stage (FIGS. 7 to 12): For this stage, the selector according to the application, which operates in the following way, is used.

Figure 9:
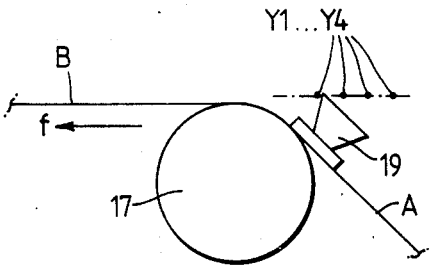
FIGS. 9 and 10 are, in the form of plan views partial representations of the selector illustrating its mode of operation.
Figure 10:
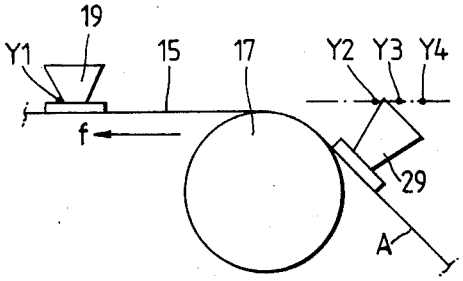

When the selector has been positioned relative to the reeling machine at the level 25 of the grasping zone (FIG. 4) according to the representation in FIGS. 7 and 8, it will be seen that the strand A forms an angle $\alpha$ of 45° with the plane S containing the threads Y1 to Y4 downstream of the notched plate 30. The belt 15 starts to move in the direction of the arrow F. The guides 19, 29, 39, 49 thus shift from a retracted position (not shown), in which they are arranged, for example, on the strand D (between the pulleys 16 and 18), in the direction of the four aligned threads. When it has arrived at the end of the strand A, at the moment when it turns onto the pulley 17, the first guide 19 encounters the thread Y1 and drives it along with it (FIGS. 7 and 9). The thread Y1 slides along the frustoconical active part and takes up position at the intersection between the latter and the base (FIG. 10). The length and diameter of the guide 19 are determined so as to allow it to grasp the thread Y1 without touching the thread Y2 The belt 15 continues to advance, driving the thread Y1 along the strand B. The guide 29, longer than the guide 19, arrives at the end of the strand A, encounters the thread Y2 and grasps it without touching the thread Y3 (FIG. 10). The operation takes place in the same way for the threads Y3 and Y4 by the means of the guides 39 and 49, each of a suitable length. At the end of travel of the belt 15 (FIG. 8), the 4 threads are positioned on the strand B, each opposite its receiving tube, according to the paths represented by unbroken lines in FIG. 12.

Figure 12:
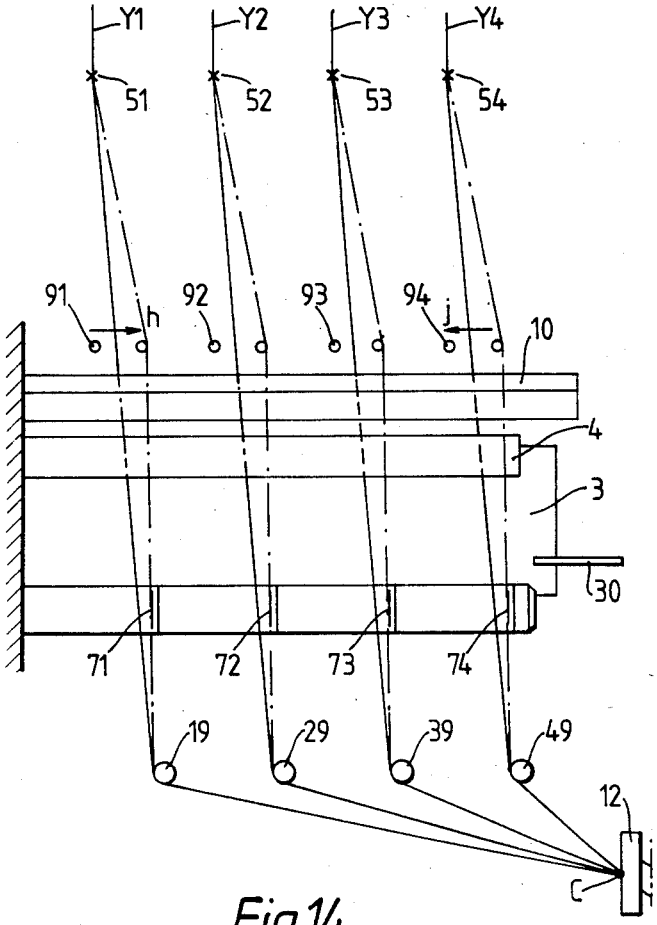

3rd stage-pick-up (FIGS. 8, 11 and 12):

The selector as a whole moves in a direction g (FIGS. 8 to 11) orthogonal to the axis of the spindle, and each thread thus comes in contact with its package tube (the path represented by the dot-and-dash line in FIG. 11). Subsequently, from the retracted position, the movable fingers 91 to 94 move simultaneously in a direction parallel to the axis of the spindle according to the arrow h (FIG. 12). Each guide thereby encounters a thread, and the latter are brought in contact with their respective pick-up slots, are grasped by them (the dot-and-dash lines in FIG. 12) and are then broken downstream of the package tubes. The packages are then started.

After the pick-up, the guides 91 to 94 simultaneously return to their original positions in one and the same movement in the direction of the arrow j, the threads continuing to bear on them and the ramp still being in the active position. If appropriate, this return movement is utilized to form a piecing end between the pick-up slot and the main package zone, by selecting a suitable return speed. If there is no need for a piecing end, there can be a faster return. At the end of the return movement, the threads escaping from the fingers are in the zone of the main package and, as result of the retraction of the ramp 10, are taken up by their respective traversing guides. The main packages are started.

Since an automatic process is concerned, the selector is of course equipped with automatic control means not described, which are integrated in the automated sequence for the automatic mechanism, this sequence itself being integrated in a wider program embracing the reeling machine and the automatic mechanism.

The selector described is only one example. There can be alternative embodiments of this both as regards the path of the belt 15 and as regards the shape of the guides 19, 29, 39, 49, although the requirements essential for the correct and reliable selection of the threads must of course be satisfied at the same time.

In the path shown in FIG. 4, the level 25 where selection takes place is advantageously chosen to be suitable for grasping either 4 threads or 2 threads if only 2 threads are wound with a double stroke length.

The means of mounting the selector on the automatic mechanism make it possible to work on a spinning frame incorporating reeling machines arranged on two levels, namely an upper level and a lower level. In this case, the selector can assume two positions offset vertically, but located at the same distance from a reference plane orthogonal to the axis of the spindle. For each upper and lower level, the point of convergence is located in a suitable position.

What is claimed is:

1. A process for the simultaneous throwing of several textile threads delivered continuously, for the purpose of winding them in separate packages on several spools mounted in spaced relation on one and the same spindle of a reeling machine, the spindle being rotated about its axis, the reeling machine also being provided with at least one traversing thread distribution device having several traversing guides and being preceded by triangulation guides, said method comprising the steps of:

(a) in a first stage:

(i) taking up all the threads downstream of the triangulation guides in a take up device;

(ii) moving the take up device to a point such that the threads pass in front of the spindle and so that the threads extend to a point of convergence defined by the position of the take up device, the point of convergence being downstream of the spindle, and whereby the threads lie in a common plane at least immediately upstream of the point of convergence;

(b) in a second stage:

(i) providing a set of movable, equally spaced guides, equal in number to the number of threads to be wound, the guides being of progressively increasing length and the spacing between the guides being equal to the spacing between the spools on the spindle;

(ii) moving the guides transverse to their length along a first path portion which is at an angle to said common plane, said first path portion including a grasping zone adjacent said common plane, whereby said movable guides each engage in turn in a separate one of said threads;

(iii) moving the guides transverse to their length along a second path portion substantially parallel to the axis of the spindle until the movable guides, with the threads thereon, are each adjacent their respective spool;

(iv) causing the yarns, during the movement along the second path portion to bear against a guide ramp parallel to the spindle, the guide ramp being in an active position which maintains them out of reach of the traversing guides;

(c) in a third stage, picking the threads up simultaneously on the spools on the rotating spindle.

2. A process according to claim 1, wherein, in the third stage, after the threads have been brought into contact with the spools, the pick-up is effected as a result of the simultaneous movement of the threads in a direction parallel to the spindle, each thread being moved to contact a pick-up slot provided on the periphery of the spool, by means of movable fingers arranged upstream of the spindle.

3. Apparatus for the simultaneous winding of several textile threads delivered continuously, said apparatus comprising a spindle rotatable about an axis and upon which several spools can be mounted in spaced relation, several triangulation guides and at least one traversing thread distribution device, several traversing guides mounted on said at least one distribution device, take up means for taking up all of the threads downstream of said triangulation guides, said take up means being positionable at a point such that the threads pass in front of the spindle at a point of convergence defined by the take up means, with the threads then lying in a common plane at least immediately upstream of the point of convergence, a set of equally spaced movable guides, equal in number to the number of threads to be wound, the movable guides being of progressively increasing length, and the spacing between the movable guides being the same as the spacing between the spools carried by said spindle, means for moving the movable guides transverse to their length along a first path portion which is at an angle to said common plane, said first path portion including a grasping zone adjacent said common plane, whereby said movable guides can each engage in turn a separate one of said threads, means for subsequently moving said movable guides transverse to their length along a second path portion substantially parallel to the axis of the spindle whereby the yarns engaged thereby can each be positioned in front of a separate one of said spools and means for picking up the threads simultaneously from said movable guides and engaging them simultaneously on a separate one of said spools.

4. Apparatus according to claim 3, wherein the means for moving said movable guides comprise an elongate flexible element movable along a first path portion which is at an angle to the common plane, and then along a second path portion which is movable parallel to the axis of the spindle and wherein the movable guides each have a base connected to said elongate flexible element and an upstanding portion.

5. Apparatus according to claim 4, wherein the flexible element is an endless belt passing around guide pulleys which define said first and second path portions.

6. Apparatus according to claim 4, wherein each guide has a thread retention means located at the intersection between its point of connection to the elongate flexible element and its active part.

7. Apparatus according to claim 6, wherein the retention means comprises a shoulder formed between the base of a generally cylindrical shape and the active part which is of generally frusto-conical shape, the narrower end of which is adjacent to the cylindrical base.

8. Apparatus according to claim 4, and further comprising an essentially straight, fixed guide, arranged in the path followed by the threads from the triangulation guides to said take up means when in said position, said straight fixed guide determining, together with the take up means, defining said common plane in which said threads lie.

9. Apparatus according to claim 8, wherein said straight fixed guide is in the form of a notched plate mounted in the plane parallel to the axis of the spindle.

10. Apparatus according to claim 9, and further comprising a guide ramp comprising a straight part parallel to the axis of the spindle and a curved part at its end, said guide ramp being positioned adjacent said plate.

* * * * *